US005846021A

United States Patent [19]

Bailey et al.

[11] Patent Number: 5,846,021

[45] Date of Patent: Dec. 8, 1998

[54] ROAD BASE MATRIX

[76] Inventors: Denzil C. Bailey; Janet A. Bailey, both of P.O. Box 442, RR#2 290, Torytown Rd., Bunker Hill, W. Va. 25413

[21] Appl. No.: 691,495

[22] Filed: Aug. 2, 1996

Related U.S. Application Data

[60] Provisional application No. 60/001,849 Aug. 2, 1995.

[51] Int. Cl.[6] ..... E01C 3/00

[52] U.S. Cl. ..... 404/28; 405/16; 52/DIG. 9; 404/40

[58] Field of Search ..... 52/DIG. 9; 236/13.1; 404/27, 28, 32, 82, 35, 16, 31, 70, 73, 40; 405/16

[56] References Cited

U.S. PATENT DOCUMENTS

| | | | |
|---|---|---|---|
| 3,764,446 | 10/1973 | Martin . | |
| 3,870,422 | 3/1975 | Medico, Jr. . | |
| 3,909,143 | 9/1975 | Cushman . | |
| 4,797,026 | 1/1989 | Webster | 404/28 |
| 4,801,217 | 1/1989 | Goldberg . | |
| 4,850,738 | 7/1989 | Niemi | 404/31 |
| 5,131,787 | 7/1992 | Goldberg . | |
| 5,172,858 | 12/1992 | Frohn . | |
| 5,236,756 | 8/1993 | Halliburton . | |
| 5,316,815 | 5/1994 | Tripp | 405/16 X |
| 5,370,475 | 12/1994 | LeBlanc | 405/16 X |
| 5,464,153 | 11/1995 | Broughton . | |

*Primary Examiner*—James Lisehora
*Attorney, Agent, or Firm*—Robert E. Bushnell, Esq.

[57] ABSTRACT

A matrix for aggregate containment and drainage system for road-base construction, or reconstruction—provides by reuse of vehicle tires. Each tire (unit) has one sidewall removed and drain holes provided in the remaining sidewall. A plurality of these units are positioned and fastened together to form a matrix. Each unit open side up, lying flat then receives aggregate construction material. The matrix configuration provides an excellent base for construction, minimizing aggregate loss due to sinking, wash out or lateral movement. A major ecological advantage is the beneficial use of otherwise problem used tires.

17 Claims, 5 Drawing Sheets

ROAD BASE MATRIX

CLAIM FOR PRIORITY

This application makes reference to, incorporates herein and claims all benefits accruing under 35 U.S.C. §119 from our provisional application entitled Road Base Matrix earlier filed in the United States Patent & Trademark Office on the 2nd of Aug. 1995, and there duly assigned Ser. No. 60/001,849.

BACKGROUND OF THE INVENTION

1. Field of the Invention

This invention relates to subsurface construction generally, and, more particularly, to stabilization of roadway and foundation construction and recycling field bartaining to used tires.

2. Background Art

In construction of roadway and other trafficked surfaces, contemporary practice in the art typically includes excavation, drainage work, base material application, followed by successive applications of aggregate and other suitable materials. It is readily apparent and observable in practice that the base or foundation layer of the road or other surface often fails evidenced by potholes, deterioration, break off, wash-out of road construction material. This failure is most generally attributed to insufficient foundation construction and inadequate drainage, and the resultant perpendicular, radial, to lateral aggregate migration. This due to characteristics in subbase material composition, cyclic freeze thaw, traffic dynamics and torsional stresses. The problems and disadvantages are visually apparent from the rough, potholed, deteriorating sometimes dangerous roadway and/or washed out berm conditions resulting from such inadequacies, to the high construction, or re-construction, patch material, aggregate replacement, labor, and maintenance costs.

The current art attempts to resolve base failure by patching, replacing lost berm materials, or excavation removal and reconstruction using a more intensive version of steel-reinforcement reinstallation of drainage systems, and increasing the depth of concrete, while characteristically improving by degree that portion of roadway. The costs are intensive and impracticable considering the thousands of miles of primary roadway and berms in need of remedy. This is even more evident when considering the more extensive secondary roads and berms. Also reflected in contemporary practice is the rigidity in base constriction underlaying the eventual viscous asphaltic "blacktop" and the all too frequent failure of many roadways more than a few years old. Much recent favorable data has demonstrated that more resilient flexible road construction techniques and innovations have merit.

The estimated three billion waste tires currently in tire dumps, and 250 million produced annually pose a formidable environmental, economic and solid waste disposal problem. This field recently has seen a plethora of proposed solutions, some with merit and noteworthy. One field has been focused on pyro-thermal reduction for disposal and energy co-generation. While certainly not without merit in some conditions, the reduction of a highly durable good, produced by relatively intensive applied technology, natural resources and no small amount of energy, by fire, is I any more than a moderate application adverse to conservation of resources thinking and direction.

Another area of endeavor has been carrying processes for the recovery of resources invested in the manufacture of tires, crumb rubber and carbon black and steel are examples. While again worthy of note, these processes call for intensive investments of energy and technology to reverse the effects of the previously applied energies used to create. Noble as these efforts are they are limited in scope of application by required large initial economic demands for the technology's construction, and energy efficiency, hence the market's ability to meet the costs demands.

A more desirable form of recycling used vehicle tires is in the field that endeavors to use the positive characteristics to produce a utility innovation. The Construction Mat Formed From Discarded Tire Beads And Method For Its Use of Goldberg, U.S. Pat. No. 4,801,217, and the Tire Mat And Method Of Construction of Goldberg, U.S. Pat. No. 5,131,787, recognize both the utility and the ecological function in using primarily used truck casings for 'raw material' for a supporting floatational mat, this constructed to form a portable floatational temporary roadway over unstable ground. While this invention certainly has merit in portability and timeliness in installation, it's scope is to a certain degree is limited to temporary applications and it's manufacture is somewhat intensive and moderately expensive. This current product and process utilizes all tires, auto, truck, and equipment in it's application as a support container drainage system in permanent roadbed or other application. Also it's manufacture is less labor and cost intensive.

The Process for Supporting a Railway Track Installation of Frohm, U.S. Pat. No. 5,172,858 describes a process for supporting railway installation, notably using whole used vehicle tires as a permanent embedded element in the railway ballast, this to prevent lateral shifting citing in railway construction as preventatives for lateral shifting of rail track, demonstrating the tire imbedded construction's stabilizing effect.

In Railroad Rail Support and Process for Manufacture of Broughton U.S. Pat. No. 5,464,153 application the use of used vehicle tires in providing a support container for adjustable rail in application. Distributing all the applied loadings experienced in railroad use across the roadbed aggregate. Here again in railroad construction art the positive recognition of the durability and desirable characteristics of tires for such applications. This present product and process connects and combines in a resilient matrix the tire bodies to whatever width or dimension desired. Together with the positive drainage characteristics gained by processing (later described), broadens it's scope but not limiting it to, roadways, berms, parking areas, trails, sports areas, and airport applications. The invention's features make to more highly adaptable to a wider range of construction and useful purposes.

While many forms of old or present art have value in their applications, none meets the direction (conservation of energy and resources), and scope or range of utility required to significantly address the challenge (three billion used tires currently in dumps, 250 million generated yearly in the U.S.A.), and the criteria of both the energy and thus economic efficiency (simplicity in design, efficiency in application).

SUMMARY OF THE INVENTION

It is therefore, an object of the present invention to prove an improved subsurface matrix.

It is another object to provide a flexible and resilient matrix.

The invention is a matrix container and drainage system for construction or reconstruction of traveled surfaces, of roads, highways, parking areas, airstrips, recreational and training areas, paths, haul and access roads etc.

When the road-base matrix is used aggregate loss by sinking (pot-hole) on lateral movement or wash-out is very substantially eliminated. Drainage by percolation can occur quickly, this is dependent on the finish surface applied.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
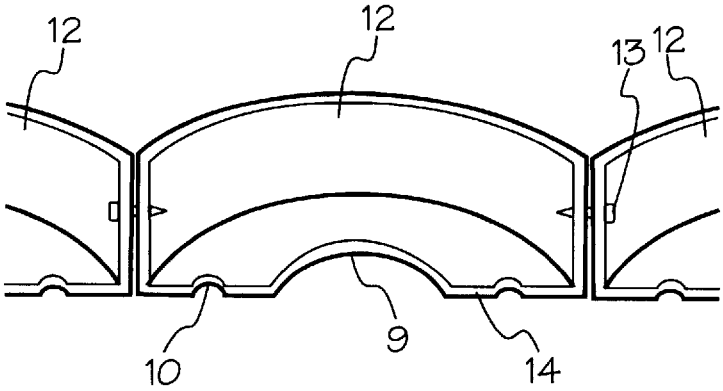
FIG. 1 is a partial sectional elevational view showing implementation of one embodiment in the practice of the present invention.

Turning now to the drawings, and referring collectively to FIGS. 1 through 7, a matrix is built easily and quickly from readily available, economically advantaged resource i.e., used tires. By cutting, drilling, or boring a minimum two (2) inch hole (10) in one sidewall of the tire. Cutting the other (opposite) sidewall (11) free, this cut (8) to follow the line of the tread concentrically (circularly) and parallel to the existing wheel opening (9) and around the entire perimeter of the tire, This cut (8) not intersecting the tread or wear surface (20). The cut away sidewall (11) to remain in the tire body.

Figure 2:
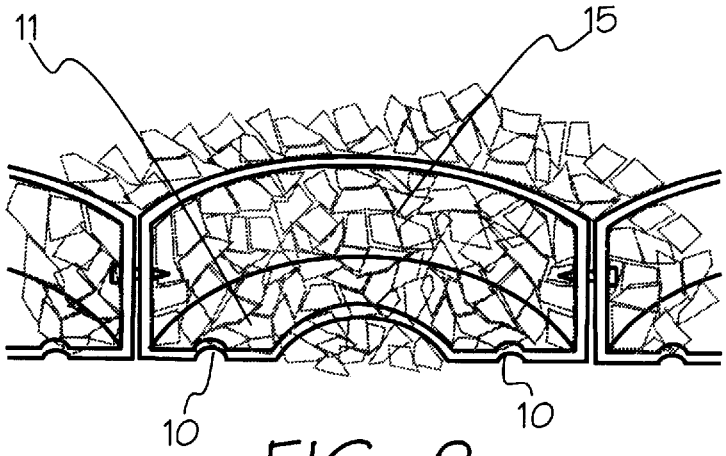
FIG. 2 is a partial sectional elevational view showing additional details of the implementation of the embodiment represented by FIG. 1.
Figure 3:
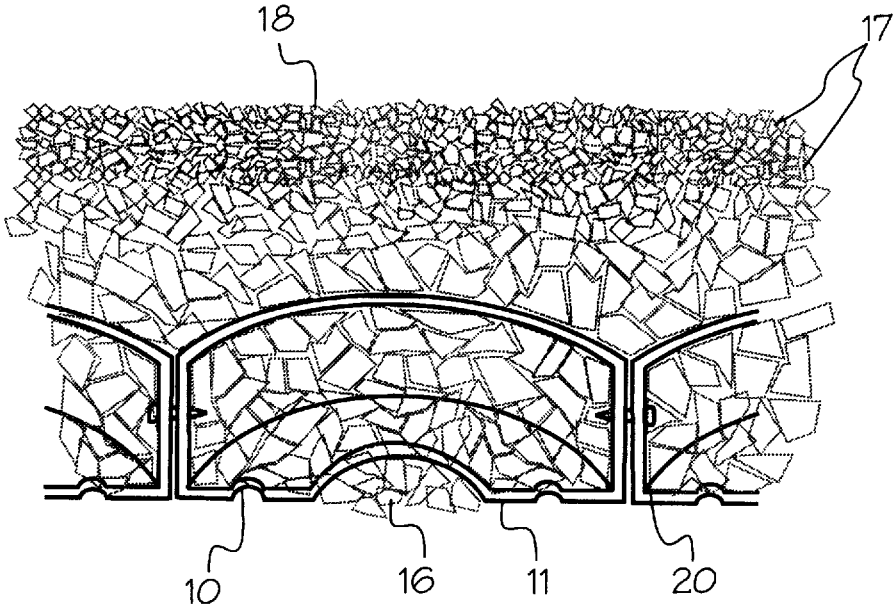
FIG. 3 is a partial sectional elevational view showing additional details of the embodiment represented by FIGS. 1 and 2.
Figure 4:
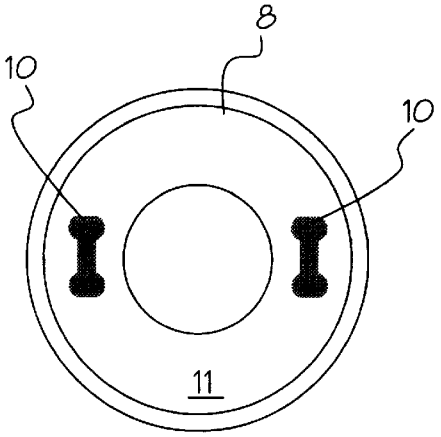
FIG. 4 is a plan view of one component of the embodiment represented by FIG. 1.
Figure 5:
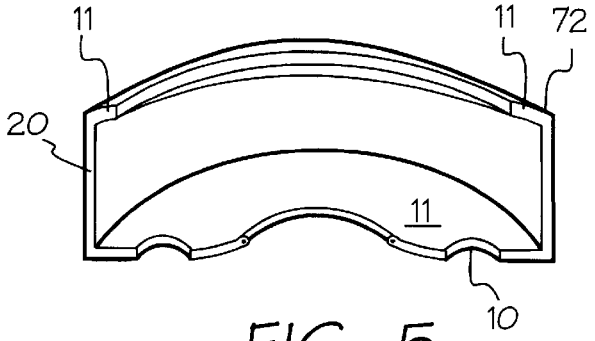
FIG. 5 is a cross-sectional elevational view showing details of a single tire constructed according to the principles of the present invention.
Figure 6:
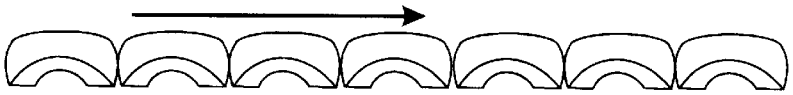
FIG. 6 is a cross-sectional elevational view of one file assembled according to the principles of the present invention.
Figure 7:
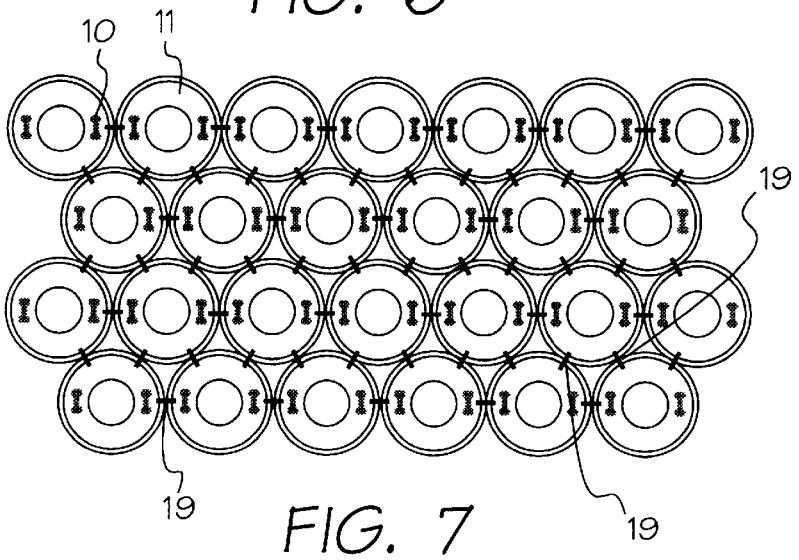
FIG. 7 is a plan view of a matrix constructed according to the principles of the present invention.

The entire upper sidewall may be removed as shown in FIGS. 1 through 3 to provide flexibility to enable the crowns of the tires to be distorted in assembling the matrix and thereby reduce the value of interstices between neighboring tires. Alternatively, as shown in FIG. 5, one to one and one-half inches, but not more than about two inches of the annular portion of the upper sidewall 72 immediately adjoining the upper most circumference of shown, to thereby make each tire 20 relatively more rigid in the matrix. The matrix could, in some applications, be filled with a porous material such as sand; but more commonly filled with crush stone and other porous road building material.

The tire, hereinafter referred to as the "unit" is then placed flat (FIG. 6 cut away view) drainage holes (10) downward FIG. 1 (12) units adjacent to one another. This process is repeated until a plurality of units are thus prepared and placed FIG. 7.

The contour design maybe varied as desired by adjusting the size and depth of the unit, and selectively placing them. This to accomplish a sloping FIG. 6, banking, or crowning affect.

These units are then fastened together at all mutually contactible points. (19) Fastening by means—mechanical (bolts, lag screws, dog bone clips) (13), chemical (adhesives solvents, vulcanizing agents) sonically bonded.

The matrix formed is placed over a porous base formed by either the newly excavated or prepared surface (construction), or over an existing surface that prepared (reconstruction).

In areas of steep grades or slope a concrete anchoring system is incorporated prior to aggregate.

Aggregate, for example, of #10 to #4 size stone, or suitable material is then used to fill and preferably to slightly cover the matrix. FIG. 2. The aggregate that penetrates downward (16) through the opening I the unit (9) serves to additionally anchor the matrix to the surface, and is sufficient alone for this purpose in normal applications. Following—aggregates of decreasing size, #3 to @2 are applied as desired.

The surface (18) is now ready for use, or membrane and/or other finish layers.

In placing the road-base matrix, improved characteristics of drainage, substantially eliminating pot-holes, and lowering maintenance cost due to stone loss are some of the obvious benefits and improvements over existing art.

The beneficial use of formerly environmental problem tires of approximately billion nationwide—U.S.A. and 250,000,000 generated yearly exhibits another highly desirable quality, environmental improvement.

Economic advantage is the instant creation ofjobs.

This product, design, and process of manufacture is the use of vulcanized rubber from used or new tires, which are cut and connected to produce a container system of interlocked units called the matrix. This matrix holds the road base material (aggregate) in place and reduces or eliminates the problem of stone loss due to washing away and or sinking.

This easily manufactured matrix is shown in the drawing attached #1 of 7.

Some of the many benefits are listed below:

(1) This road building system makes road building very inexpensive.

(2) With this matrix roads may be built in many varying terrains, some with minimal excavations.

(3) Enables very efficient drainage (4) Provides an excellent method for utilizing, otherwise environmental "problem tires".

(5) Virtually eliminates "pot-holes".

(6) The matrix enables the use of many varying material for road base construction not formally usable.

(7) Reduced road maintenance costs.

In describing the process of manufacture the use of standard automobile tires is envisioned, the basic process does not significantly differ in applications using truck and equipment tires.

Figure 8:
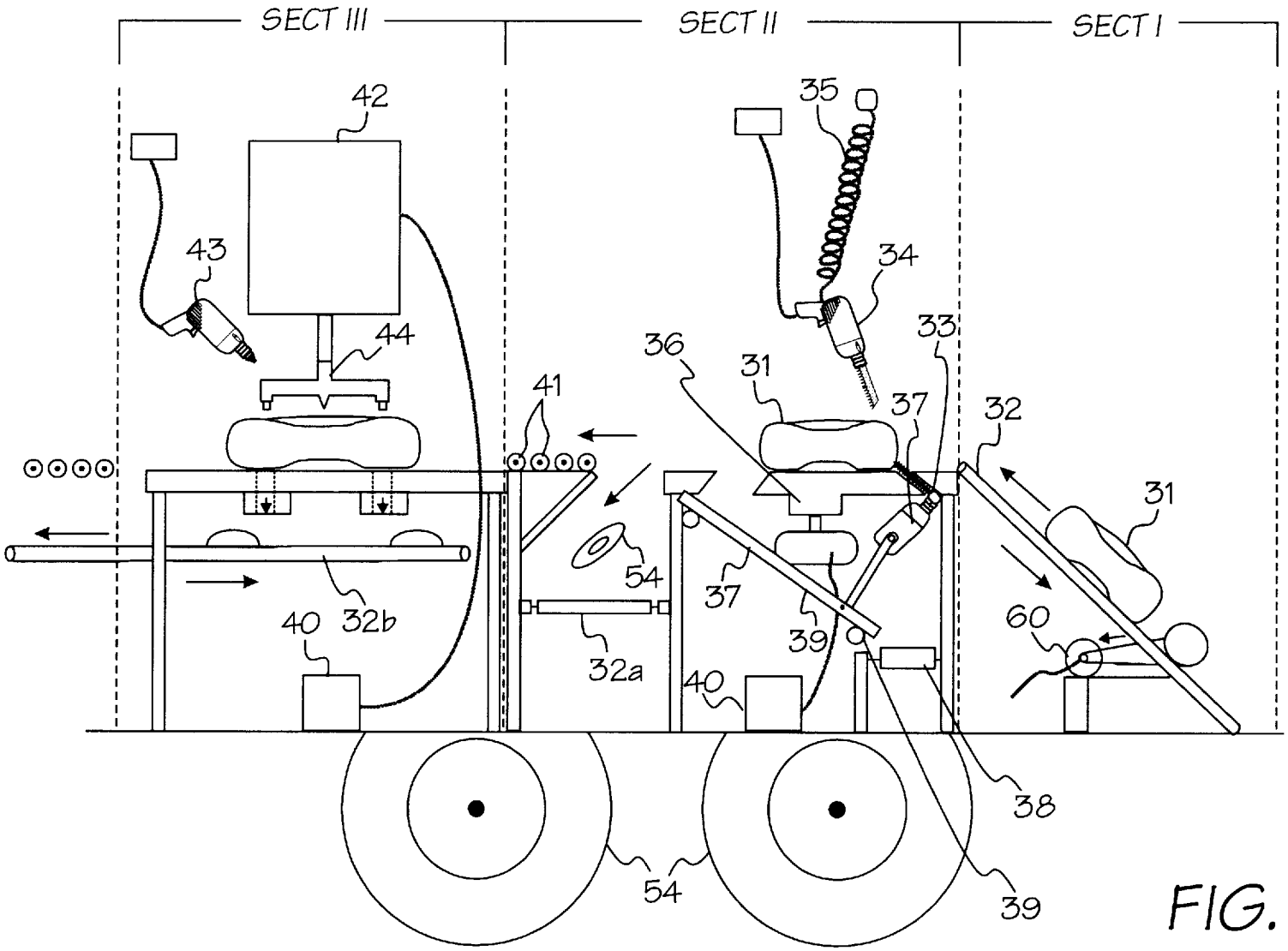
FIG. 8 is an elevational view showing three process sections for fabrication of a matrix.

Shown in FIG. 8, section I, as preferred method is a powered (6), conveyor (32), lifting or moving the whole tire (31), to an appropriate working elevation.

FIG. 8, section II, shows an electric powered, fix mounted reciprocating type cutting device (33), angle and depth adjustable. Alternatively, a hand held similar cutting device such as a reciprocating saw (34), is shown, a hand held similar supported by a spring device (35) this to free hands to move material etc. and powered by an overhead source so as to eliminate cord entanglement and hazard of inadvertently cutting the power cord. Additionally the tire while being so processed rests and is physically engaged upon a rotating disc(36)powered from beneath by an electric motor that is speed controlled by a foot control (40). The crumb rubber residue generated by the foregoing cutting action falls upon a slant tray (39), that is rubber mounted at each end and rigidly attached (37), to either or both the motor powering the disc and/or the fixed cutter producing in the tray a vibratory action moving the residue to conveyor (38), for disposition. The removed tire sidewall (54), also falls to a powered conveyor **(32*a*), and is removed from this process for disposition. The unit being processed is then moved to another work station on a conveyor (41)**.

Figure 10A:
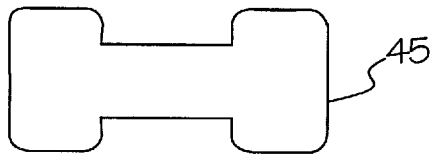
FIGS. 10A and 10B is a perspective view of punched-out section from a sidewall of a tire.
Figure 10B:
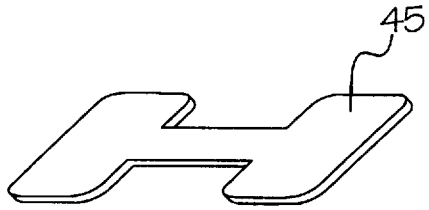
Figure 11:
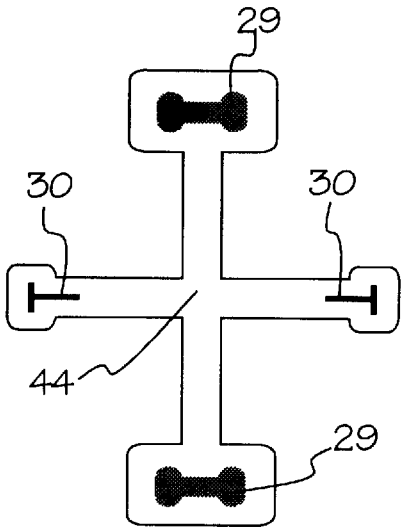
FIG. 11 is a bottom view of a presshead for forming the punched-out sections shown in FIG. 10.
Figure 12:
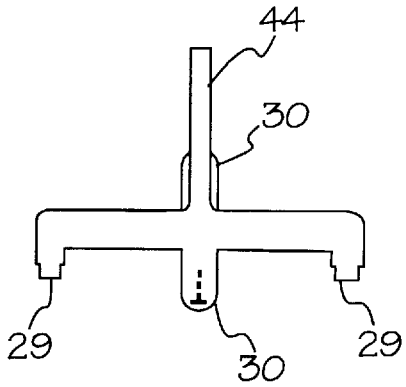
FIG. 12 is a sideview of the presshead shown in FIG. 11.

FIG. 8, section III, shows a press mounted cutting device (42), powered, for safety through a foot control. This station is for providing drainage holes in the remaining sidewall of the unit, this by pressing the cutting head (44), through the aide wall. The press head (44), (FIG. 11) providing both drainage holes and "T" slots in the remaining sidewall, these alternately and at right angle from each other as shown in bottom and aide views in (FIG. 11), components (optional) for the matrix fastening system in side and angle views (FIG. 10), being formed, (cut-out) in the process. The alternatively drainage may be simply provided by a hand held power cutting tool (43), here a hammer drill equipped with a hole saw attachment.

Figure 9:
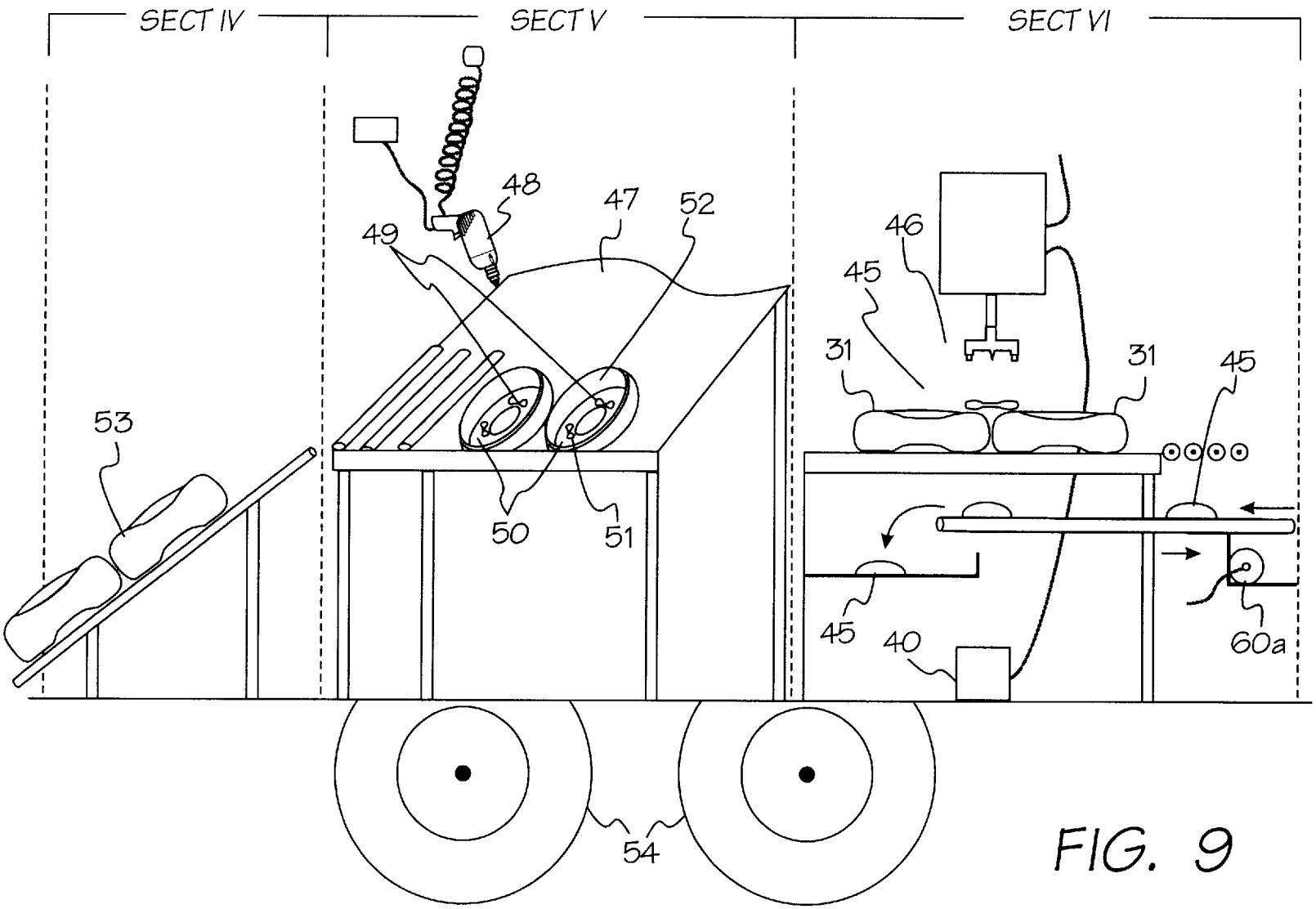
FIG. 9 is an elevational view showing three process steps subsequent to those illustrated in FIG. 8, in the fabrication of the matrix.

FIG. 9, section IV, shows both the unit and the fastening components moving to another work station via conveyors **(41*a*), and (32*b*), respectively. At this station the units are joined, components (45), shown in (FIG. 10), is precessed as shown through slot (5), formed by the press head (44), FIG. 11, (30)**.

FIG. 9, section II, the units here table (47), shown as (51), optionally, application connected by component (45), shown as (51), optionally, application dependent, then a screw, bolt or adhesive, or as envisioned sonicly welded also at that contact point. If not jointed by component (45), then fastening (52), occurs here, lag screw, bolt, adhesive, welded. Shown fastening by lag screw (52), applied by powered hammer drill (48).

FIG. 9, section II, optionally, with the addition of wheels 54, the entire process assembly may be mounted on a trailer truck or other mobile unit.

We claim:

1. A road base matrix, comprised of:

a plurality of automotive tires positioned in a generally planar array with each of said tires comprising a cylindrical crown exhibiting an uppermost circular periphery and a lowermost circular periphery separated by said crown from said uppermost circular periphery, and a first annular sidewall integrally joining said lowermost circular periphery of said crown, each said first annular sidewall disposed upon a porous base underlying the matrix and defining a first central aperture exhibiting a first radial dimension along a plane of said matrix and opening directly to the base, said uppermost circular periphery defining a second and substantially greater radial dimension, and a second annular sidewall integrally joining and extending radially from said uppermost periphery of each of a multiplicity of said crowns, with each of said second annular sidewalls defining a corresponding second central aperture substantially greater in size than said first central aperture; and a plurality of elongated means extending radially through crowns of adjacent ones of said tires, for joining neighboring ones of said tires together in said matrix.

2. The matrix of claim 1, further comprised of each said tire forming an open cavity, and a mass of an aggregate deposited upon the base exposed by said first central aperture and filling each said cavity and interstices formed between said neighboring ones of said tires within said matrix.

3. The matrix of claim 1, comprised of:

each said first annular sidewall being perforated by a slit; and said plurality of elongated means comprising a length of a flexible and pliable material having an narrowed central member terminated at opposite ends by enlarged sections having cross-sectional widths greater than said central member, one-half of said cross-sectional widths being dimensionally less than of said slit;

said enlarged sections lying with open cavities formed by said neighboring ones of said tires while corresponding ones of said lengths extend through said crossed-slits and between the base and adjacent portions of said first annular sidewalls of said neighboring ones of said tires; and said first annular sidewalls being perforated by weep holes extending through said first annular sidewalls to the base, with said weep holes being formed by removal of corresponding individual ones of said elongated means from said first annular sidewalls.

4. The matrix of claim 1, comprised of an interior circumference of a multiplicity of said tires defining said second radial dimension.

5. The matrix of claim 1, with said tires comprised of:

a plurality of said crowns forming a web encased in a pliant, flexible material impervious to water; and said plurality of elongated means engaging and extending through a web of each of said plurality of crowns.

6. The matrix of claim 1, comprised of a plurality of sidewalls of said tires each being perforated by different orifices extending through corresponding ones of said sidewalls.

7. The matrix of claim 1, comprised of a plurality of said first annular sidewalls of said tires being perforated by a multiplicity of orifices extending through corresponding ones of said sidewalls and opening to the base.

8. A road base matrix, comprised of:

a plurality of automotive tires positioned in a generally planar array with each of said tires comprising:

a cylindrical crown formed by a continuous web impregnated with a pliant, flexible material, said crown exhibiting an uppermost circular periphery and a lowermost circular periphery separated by said crown from said uppermost circular periphery;

a first annular sidewall integrally joining said lowermost circular periphery of said crown, said first annular sidewall disposed upon a porous base underlying the matrix with said crown extending upwardly and axially away from said first annular sidewall and defining a first central aperture exhibiting a first radial dimension within a plane of said matrix and opening directly to the base, said first annular sidewall being perforated by an orifice extending through said first annular sidewall to the base, said uppermost circular periphery defining a second central aperture exhibiting a second and substantially greater radial dimension; and a second annular sidewall integrally joining said uppermost circular periphery of said crown, exhibiting a second radial dimension within said plane substantially less than one-fourth of said first radial dimension;

said crown, said first annular sidewall and said second annular sidewall forming a singular integrated and monolithic structure; and a plurality of elongated means extending radially through crowns of adjacent ones of said tires, for joining tangentially neighboring ones of said tires together in said matrix.

9. The matrix of claim 8, comprised of:

each said first annular sidewall being perforated by a slit; and said plurality of elongated means comprising a length of a flexible and pliable material having an narrowed central member terminated at opposite ends by enlarged sections having cross-sectional widths greater than said central member one-half of said cross-sectional widths being dimensionally less than of said slit;

said enlarged sections lying with open cavities formed by said neighboring ones of said tires while corresponding ones of said lengths extend through said crossed-slits and between the base and adjacent portions of said first annular sidewalls of said neighboring ones of said tires.

10. The matrix of claim 8, comprised of:

each said first annular sidewall being perforated by a slit; and said plurality of elongated means comprising a length of a flexible and pliable material having an narrowed central member terminated at opposite ends by enlarged sections having cross-sectional widths greater than said central member, one-half of said cross-sectional widths being dimensionally less than of said slit;

said enlarged sections lying with open cavities formed by said neighboring ones of said tires while corresponding ones of said lengths extend through said crossed-slits and between the base and adjacent portions of said first annular sidewalls of said neighboring ones of said tires; and said first annular sidewalls being perforated by weep holes extending through said first annular sidewalls to the base, with said weep holes being formed by removal of corresponding individual ones of said elongated means from said first annular sidewalls.

11. The matrix of claim 8, further comprised of each said tire forming an open cavity extending between said first central aperture and said uppermost circular periphery, and a mass of an aggregate accommodating passage of water through said cavity via said first central aperture to said base, said mass being deposited upon the base exposed by said first central aperture and filling each said cavity and interstices formed between said neighboring ones of said tires within said matrix.

12. The matrix of claim 8, with said plurality of elongated means comprised of threaded lag bolts extending radially between abutting said crowns of said neighboring tires.

13. A road base matrix, comprised of:

a plurality of automotive tires positioned in a generally planar array with each of said tires comprising:

a cylindrical crown formed by a continuous web impregnated with a pliant, flexible material, said crown exhibiting an uppermost circular periphery and a lowermost circular periphery separated by said crown from said uppermost circular periphery;

a first annular sidewall integrally joining said lowermost circular periphery of said crown, said first annular sidewall disposed upon a porous base underlying the matrix with said crown extending upwardly and axially away from said first annular sidewall and defining a first central aperture exhibiting a first radial dimension within a plane of said matrix and opening directly to the base, said first annular sidewall being perforated by an orifice extending through said first annular sidewall to the base, said uppermost circular periphery defining a second and substantially greater radial dimension; and a second annular sidewall integrally joining said uppermost circular periphery of said crown, exhibiting a third radial dimension within said plane substantially less than one-fourth of said first radial dimension;

said crown, said first annular sidewall and said second annular sidewall forming a singular integrated and monolithic structure; and a plurality of elongated means extending radially through said monolithic structure of adjacent ones of said tires, for joining tangentially neighboring ones of said tires together in an ordered array within said matrix.

14. The matrix of claim 13, with said base comprising a tennis court.

15. The matrix of claim 13, comprised of:

each said first annular sidewall being perforated by a plurality of sets of crossed-slits; and said plurality of elongated means comprising a length of a flexible and pliable material having an narrowed central length terminated at opposite ends by enlarged sections having cross-sectional widths greater than said central length, one-half of said cross-sectional widths being dimensionally less than a greatest length of said slits;

said enlarged sections lying with open cavities formed by said neighboring ones of said tires while corresponding ones of said lengths extend through said crossed-slits and between the base and adjacent portions of said first annular sidewalls of said neighboring ones of said tires; and said first annular sidewalls being perforated by weep holes extending through said first annular sidewalls to the base, with said weep holes being formed by removal of corresponding individual ones of said elongated means from said first annular sidewalls.

16. The matrix of claim 13, with said plurality of elongated means comprised of portions of said first annular sidewalls punched as H-shaped units.

17. The matrix of claim 13, with said crossed-slits forming T-shapes.

* * * * *